US009302810B2

(12) United States Patent
Cavalcante

(10) Patent No.: US 9,302,810 B2
(45) Date of Patent: Apr. 5, 2016

(54) BAKERY TRAY

(75) Inventor: Mauricio D. Cavalcante, Atlanta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 391 days.

(21) Appl. No.: 12/571,757

(22) Filed: Oct. 1, 2009

(65) Prior Publication Data

US 2010/0084304 A1 Apr. 8, 2010

Related U.S. Application Data

(60) Provisional application No. 61/102,246, filed on Oct. 2, 2008.

(51) Int. Cl.
*B65D 21/00* (2006.01)
*B65D 21/04* (2006.01)
*B65D 1/34* (2006.01)

(52) U.S. Cl.
CPC ..... *B65D 21/046* (2013.01); *B65D 1/34* (2013.01)

(58) Field of Classification Search
CPC ..... B65D 1/34; B65D 21/046
USPC ..... 206/507, 509, 511, 557
See application file for complete search history.

(56) References Cited

U.S. PATENT DOCUMENTS

RE26,350 E 2/1968 Wilson
3,420,402 A 1/1969 Frater et al.
3,438,544 A * 4/1969 Cloyd ..... 206/596
3,613,943 A 10/1971 Bridenstine
D224,366 S 7/1972 Rehrig
3,675,815 A 7/1972 Rehrig
3,780,905 A * 12/1973 Herolzer ..... 206/507
3,825,114 A 7/1974 Johnson et al.
3,865,239 A 2/1975 Herolzer et al.
3,937,327 A 2/1976 Carroll
3,951,265 A 4/1976 Carroll
4,000,817 A 1/1977 Sanders et al.

(Continued)

FOREIGN PATENT DOCUMENTS

CA 2276863 * 2/2000 ..... B65D 21/04
CA 2408247 11/2001

(Continued)

OTHER PUBLICATIONS

UK Search Report for UK Application No. GB0722623.6, Feb. 18, 2008.

(Continued)

*Primary Examiner* — Fenn Mathew
*Assistant Examiner* — Elizabeth Volz
(74) *Attorney, Agent, or Firm* — Carlson, Gaskey & Olds P.C.

(57) ABSTRACT

A tray, such as for baked goods, includes a base and a pair of opposed side walls extending upward from side edges of the base. A front wall and a rear wall extend upward from a front edge and a rear edge of the base. The front wall and rear wall each have at least a portion that is shorter than the side walls. The front wall and rear wall each include an inner wall portion spaced inwardly of an outer wall portion. The front wall and rear wall each including at least one portion of reduced width at an upper edge of the front wall and the rear wall. The portion of reduced width accommodates the notches of a similar tray cross stacked thereon.

23 Claims, 6 Drawing Sheets

(56) References Cited

U.S. PATENT DOCUMENTS

| | | | | | |
|---|---|---|---|---|---|
| 4,023,680 | A | * | 5/1977 | Thurman | 206/507 |
| D247,648 | S | | 3/1978 | Carroll et al. | |
| 4,093,070 | A | | 6/1978 | Stahl | |
| 4,093,071 | A | * | 6/1978 | Stahl et al. | 206/507 |
| 4,102,453 | A | | 7/1978 | Carroll et al. | |
| D249,185 | S | | 8/1978 | Carroll et al. | |
| 4,106,624 | A | | 8/1978 | Thurman | |
| 4,106,625 | A | | 8/1978 | Carroll et al. | |
| 4,109,791 | A | | 8/1978 | Clipson et al. | |
| 4,189,052 | A | | 2/1980 | Carroll et al. | |
| 4,238,032 | A | | 12/1980 | Thurman | |
| 4,320,837 | A | | 3/1982 | Carroll et al. | |
| 4,364,477 | A | | 12/1982 | Stromberg | |
| 4,379,508 | A | | 4/1983 | Miller et al. | |
| 4,423,813 | A | | 1/1984 | Kreeger | |
| 4,519,503 | A | | 5/1985 | Wilson | |
| 4,523,681 | A | | 6/1985 | Kreeger | |
| 4,759,451 | A | | 7/1988 | Apps | |
| 4,807,756 | A | | 2/1989 | Young et al. | |
| 4,936,458 | A | | 6/1990 | Tabler et al. | |
| 4,960,207 | A | * | 10/1990 | Tabler et al. | 206/507 |
| 4,982,844 | A | | 1/1991 | Madan et al. | |
| 5,035,326 | A | * | 7/1991 | Stahl | 206/507 |
| D319,908 | S | | 9/1991 | Stahl | |
| 5,287,966 | A | | 2/1994 | Stahl | |
| D348,138 | S | | 6/1994 | Lang-Ree et al. | |
| D348,344 | S | | 6/1994 | Apps | |
| D350,028 | S | | 8/1994 | Apps | |
| 5,344,022 | A | | 9/1994 | Stahl | |
| 5,372,257 | A | * | 12/1994 | Beauchamp et al. | 206/504 |
| 5,582,296 | A | * | 12/1996 | Beauchamp et al. | 206/503 |
| 5,881,902 | A | * | 3/1999 | Ackermann | 206/509 |
| 5,921,566 | A | | 7/1999 | Kern et al. | |
| 5,979,654 | A | | 11/1999 | Apps | |
| D439,049 | S | | 3/2001 | Koefelda | |
| 6,260,706 | B1 | * | 7/2001 | Koefelda | 206/505 |
| 6,273,259 | B1 | | 8/2001 | Stahl | |
| 6,394,274 | B1 | | 5/2002 | Cheeseman | |
| 6,607,199 | B2 | | 8/2003 | Gruber | |
| 6,857,642 | B2 | | 2/2005 | Gruber | |
| 6,886,710 | B2 | * | 5/2005 | Verna et al. | 220/507 |
| 6,953,116 | B2 | * | 10/2005 | Verna et al. | 206/507 |
| 7,320,405 | B2 | * | 1/2008 | Stahl | 206/509 |
| 7,484,621 | B2 | | 2/2009 | Apps | |
| D598,684 | S | | 8/2009 | Stahl | |
| 7,637,373 | B2 | | 12/2009 | Stahl | |
| 7,686,167 | B1 | | 3/2010 | Stahl | |
| 7,784,615 | B2 | | 8/2010 | Stahl | |
| 7,861,864 | B2 | | 1/2011 | Hassell et al. | |
| 2002/0153682 | A1 | | 10/2002 | Gruber | |
| 2003/0183549 | A1 | | 10/2003 | Verna et al. | |
| 2003/0205495 | A1 | | 11/2003 | Verna et al. | |
| 2004/0050742 | A1 | | 3/2004 | Gruber | |
| 2004/0060844 | A1 | | 4/2004 | Stahl | |
| 2004/0144680 | A1 | | 7/2004 | Stahl | |
| 2005/0183980 | A1 | | 8/2005 | Fernandez et al. | |
| 2006/0070906 | A1 | | 4/2006 | Verna et al. | |
| 2007/0187276 | A1 | | 8/2007 | Stahl | |
| 2008/0116100 | A1 | * | 5/2008 | Hassell et al. | 206/507 |
| 2010/0084304 | A1 | * | 4/2010 | Cavalcante | 206/509 |
| 2011/0037237 | A1 | | 2/2011 | Hassell | |

FOREIGN PATENT DOCUMENTS

| | | |
|---|---|---|
| CA | 2448920 | 7/2004 |
| WO | 01/30660 | 5/2001 |
| WO | 0130660 | 5/2001 |

OTHER PUBLICATIONS

United Kingdom Search Report for GB Application No. 0917252.9, Feb. 2, 2010.

* cited by examiner

BAKERY TRAY

This invention claims priority to U.S. Provisional Application Ser. No. 61/102,246, filed Oct. 2, 2008.

BACKGROUND OF THE INVENTION

The present invention relates generally to a tray for baked goods,

Existing molded plastic trays for shipping and storing baked goods include opposite side walls extending upwardly from a base. Front and rear walls are lower than the side walls in order to provide access to the baked goods when the trays are stacked. The side walls include rails that permit the trays to slide and interlock with one another for stacking.

The shorter front and rear walls in the current trays reduce the strength of the tray, particularly when supporting hot baked goods. Thus, the current trays are susceptible to breakage.

SUMMARY OF THE INVENTION

A tray, such as for baked goods, includes a base and a pair of opposed side walls extending upward from side edges of the base. A front wall and a rear wall extend upward from a front edge and a rear edge of the base. The front wall and rear wall each have at least a portion that is shorter than the side walls. The front wall and rear wall each include an inner wall portion spaced inwardly of an outer wall portion. The front wall and rear wall each including at least one portion of reduced width at an upper edge of the front wall and the rear wall. The portion of reduced width accommodates the notches of a similar tray cross stacked thereon.

DETAILED DESCRIPTION OF THE PREFERRED EMBODIMENT

Figure 1:
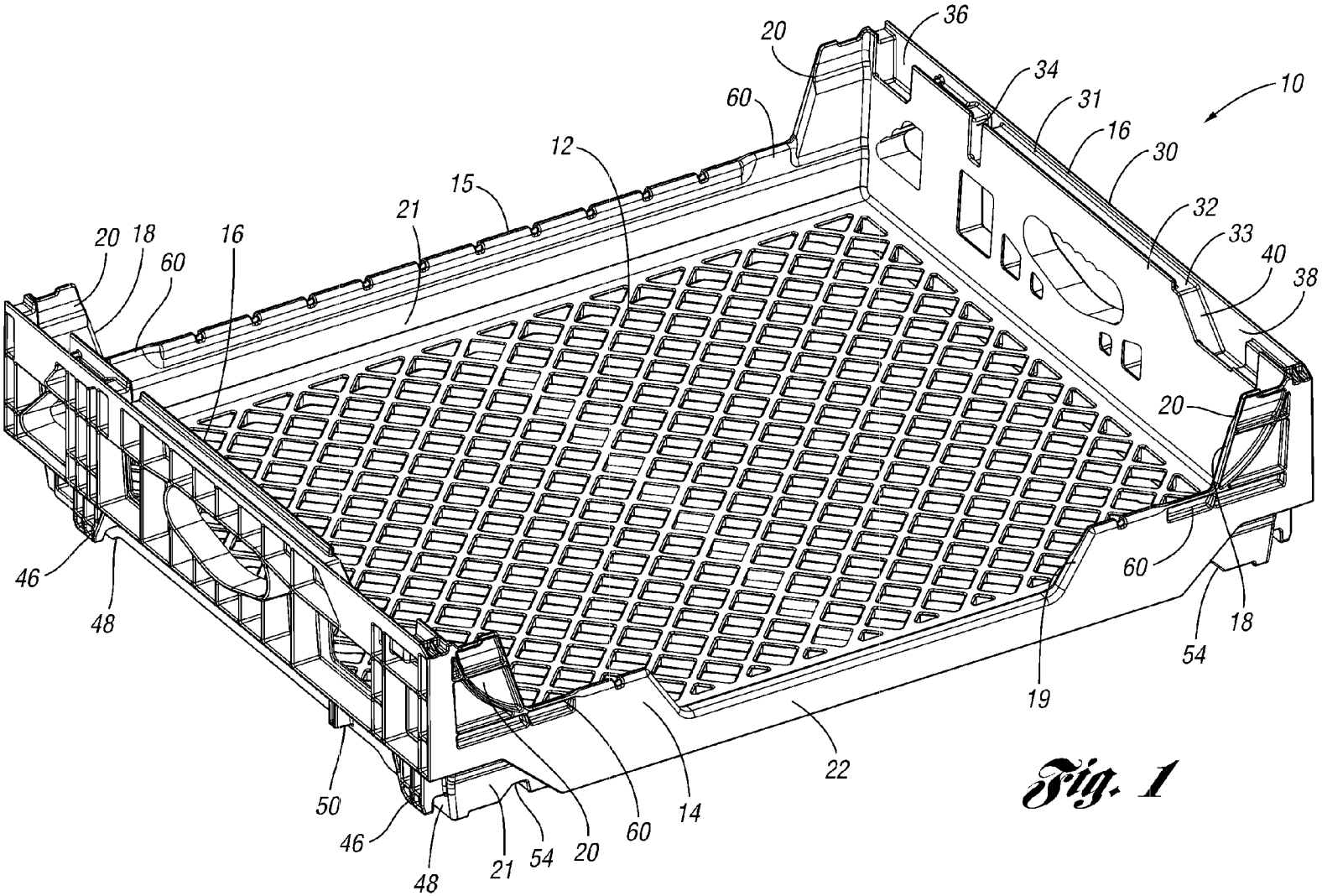
FIG. 1 is a perspective view of a bakery tray according to one example embodiment of the present invention.

A tray 10 according to one embodiment of the present invention is shown in FIG. 1. The tray 10 includes a base 12 having a front wall 14, a rear wall 15 and opposite side walls 16. The front and rear walls 14, 15 are shorter than the side walls 16 to create an access window 18, so that the goods stored on the base 12 can be accessed even when additional, similar trays are stacked on the tray 10. The front wall 14 includes a second cutout or opening 19 to provide even easier access to the interior of the tray 10. Lateral flanges 20 extend inward from the side walls 16, slightly narrowing the windows 18 in order to reinforce the corner intersections between the front and rear walls 14, 15 and the side walls 16.

The front and rear walls 14, 15 each include an inner wall 21 continuous with the base 12 and an outwardly spaced outer wall or lip 22 providing structural reinforcement to the front and rear walls 14, 15. Ribs or gussets connect the inner wall 21 and lip 22.

The side walls 16 each include an outer rail 30 and a lower, inner rail 32. A channel 31 defined between the inner rail 32 and the outer rail 30 includes a bottom surface 33 having an inclined portion 40. A vertical slot 34 opens to the interior of the tray 10, and interrupts the channel 31 and the inner rail 32. A first outer pocket 36 also opens toward the interior of the tray 10. A second outer pocket 38 opens toward the interior of the tray 10 and is continuous with the inclined portion 40. The vertical slot 34, first outer pocket 36 and second outer pocket 38 are sized and spaced to receive an inner foot 50 and outer feet 46 of a similar tray 10 stacked thereon.

Relative to the prior art trays, the inner wall 21 and lip 22 are spaced farther apart, thus increasing the size and strength of the ribs or gussets in between and improving the overall strength and stiffness of the front and rear walls 14, 15. Additionally, the increased spacing between the inner wall 21 and lip 22 increases the size of the corresponding areas in the mold, thereby increasing the durability of the mold. In order to accommodate the increased width of the front and rear walls 14, 15 into notches on prior art trays for cross stacking, reduced width portions 60 are formed in the front and rear walls 14, 15 adjacent the flanges 20.

Figure 2:
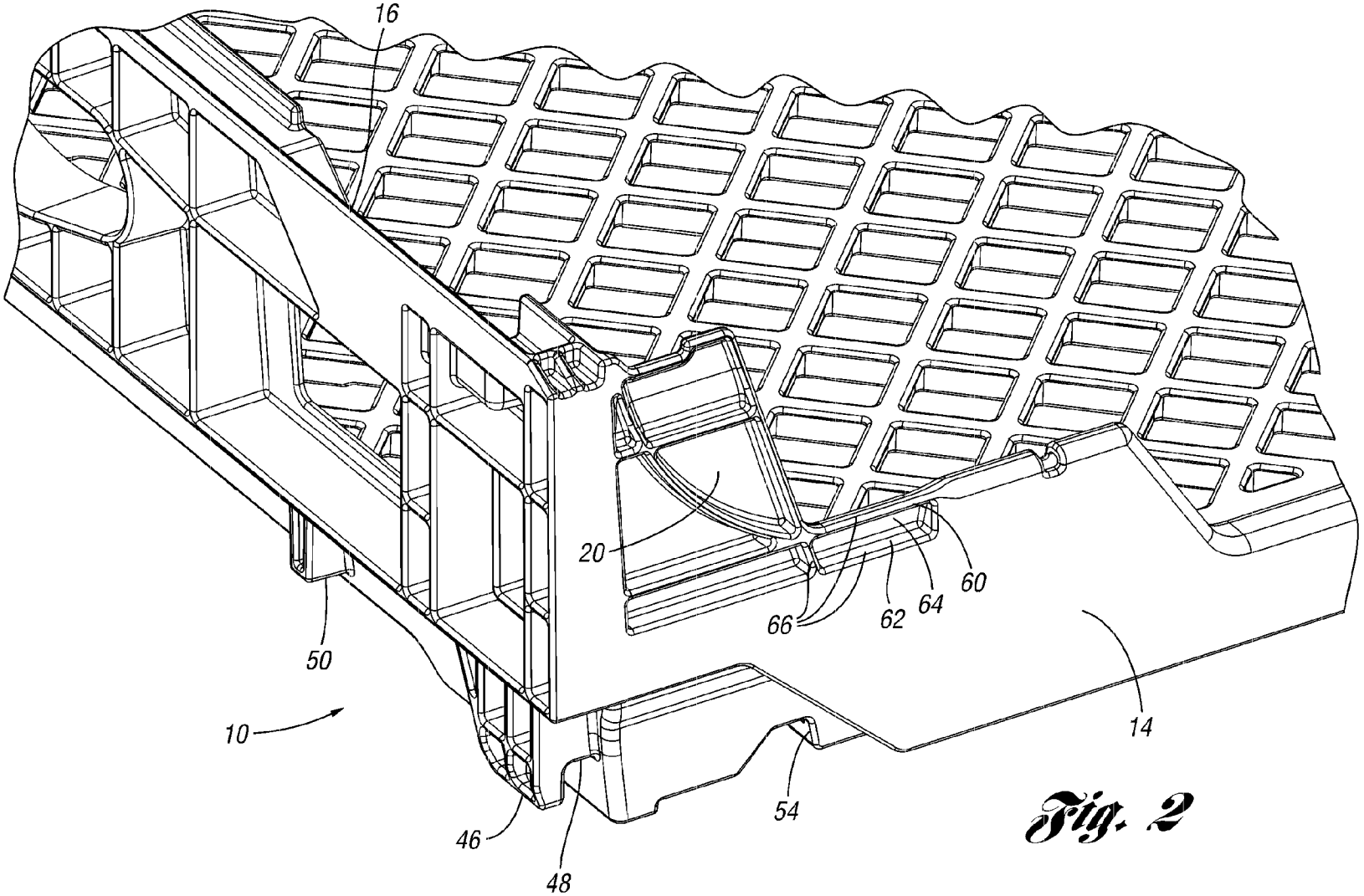
FIG. 2 is an enlarged exterior view of a front corner of the tray of FIG. 1.

Referring to FIG. 2, the reduced width portions 60 include a single upright interior wall 64 having peripheral ribs 66 formed around a recess 62 toward the exterior of the tray 10. The recess 62 can be formed by a slide in the mold.

Each of the outer feet 46 includes a channel 48 opening downwardly from a lower end. The inner wall 21 of the front and rear walls 14, 15 include a pair of notches 54 formed on a lower edge. The notches 54 receive the upper edges of the front and rear walls 14, 15 when cross-stacking multiple trays 10.

Figure 3:
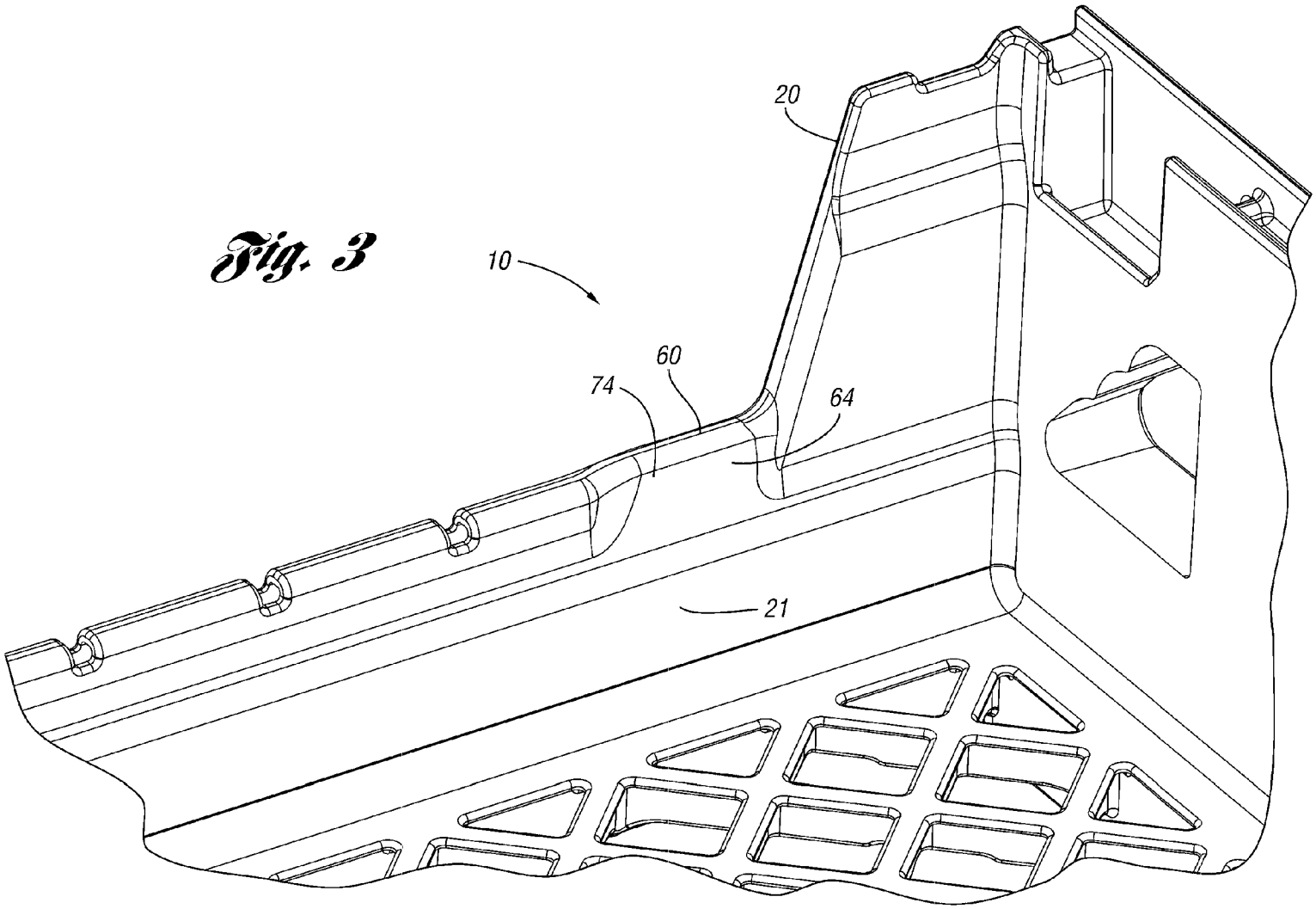
FIG. 3 is an enlarged interior view a rear corner of FIG. 1.

FIG. 3 is an interior view of one of the rear corners of the tray 10 of FIG. 1. The interior wall 64 of the reduced width portion 60 is continuous with the inner wall 21, but offset toward the exterior, thereby forming a slight recess 74 on the interior surface of the inner wall 21.

Figure 4:
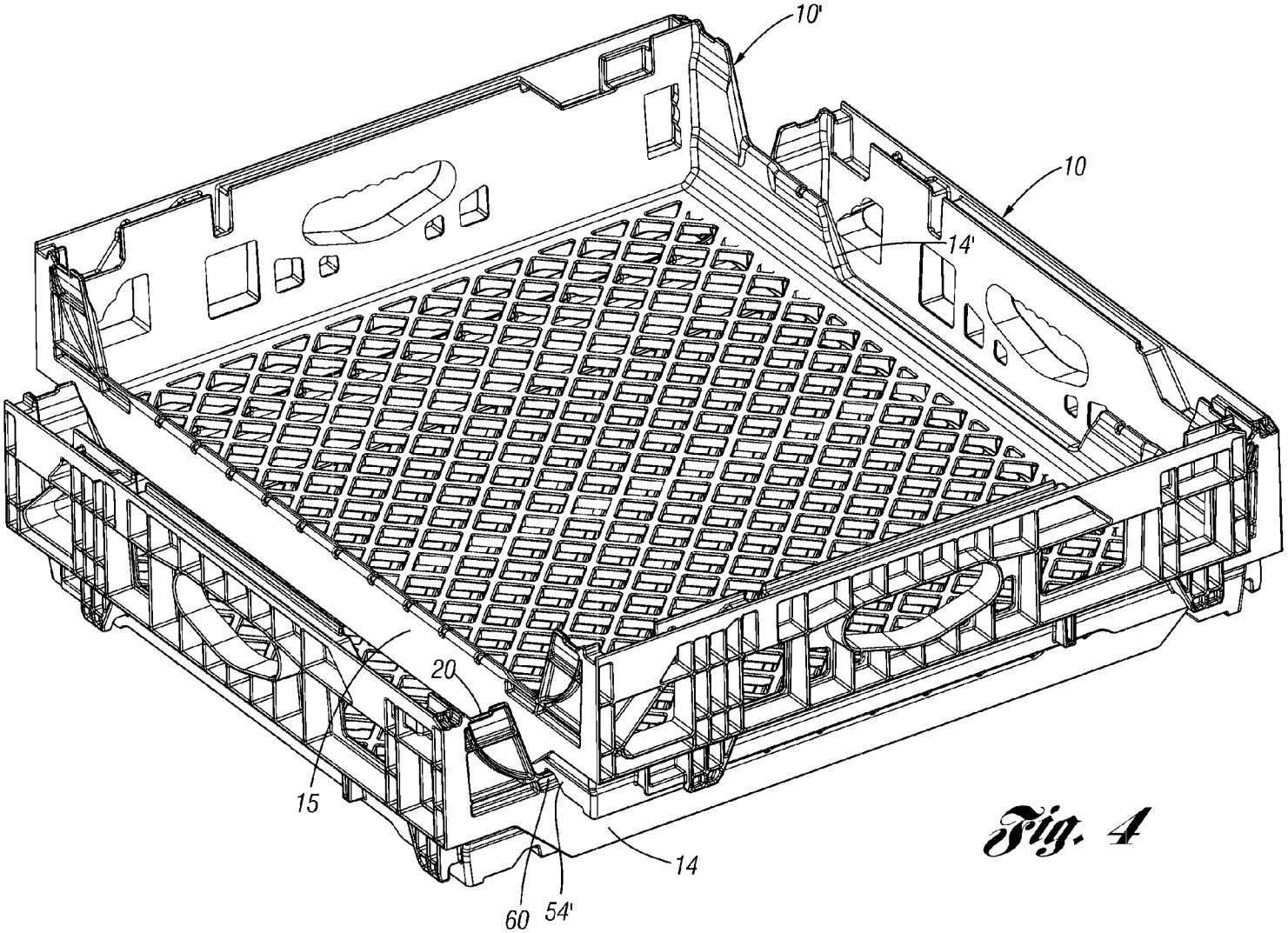
FIG. 4 shows the tray of FIG. 1 with an identical tray cross-stacked thereon.

FIG. 4 illustrates two of the trays 10, 10' cross stacked. The reduced width portions 60 of the front and rear walls 14, 15 of the lower tray 10 are received in the notches 54' of the upper tray 10'. This reduces the overall stacking height of empty trays 10, 10'.

Figure 5:
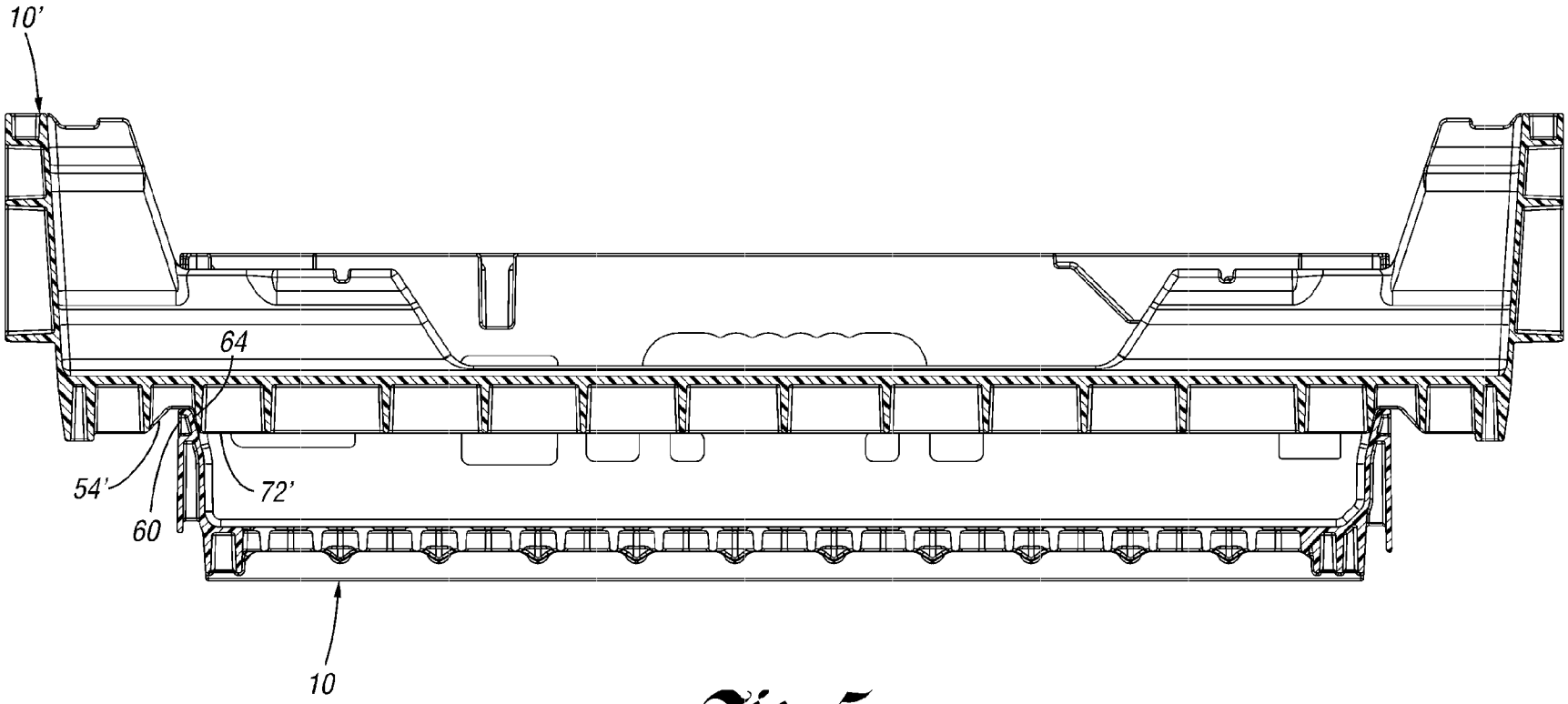
FIG. 5 is a section view through the trays of FIG. 4.
Figure 6:
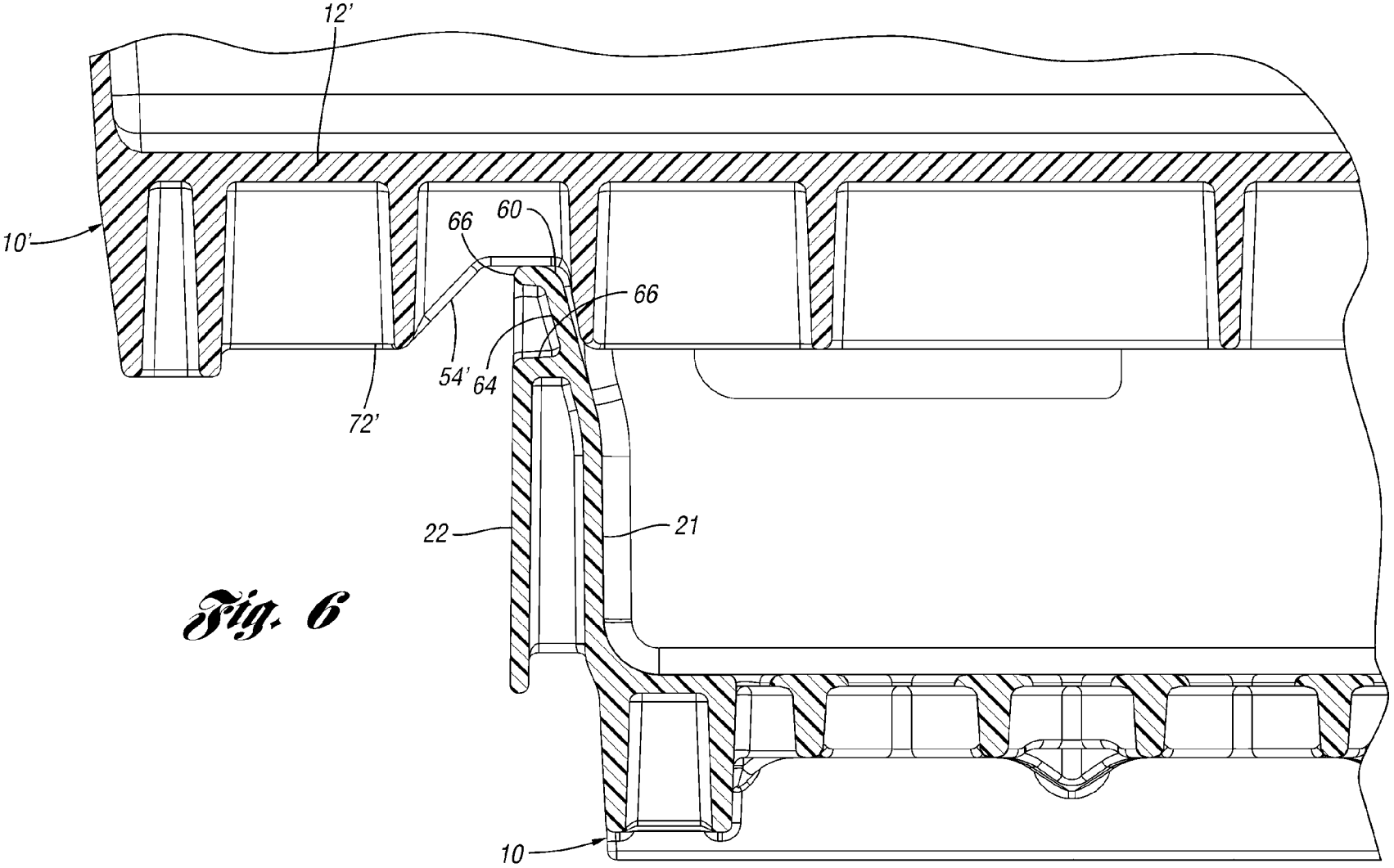
FIG. 6 is an enlarged view of a portion of FIG. 5.

FIG. 5 is a section view of the trays 10, 10' of FIG. 4. FIG. 6 is an enlarged view of a portion of FIG. 5. As shown, the notches 54' are formed in a lateral rib 72' extending across the upper tray 10'. The reduced width portions 60 of the front and rear walls 14, 15 of the lower tray 10 are received in the notches 54' of the upper tray 10', and the lateral rib 72' of the upper tray 10' bears against the interior wall 64 of the reduced width portion 60 to prevent relative movement of the trays 10, 10'. FIG. 6 also illustrates one of the gussets or ribs 76 connecting the interior wall 21 to the lip 22.

The reduced width portions 60 permit the increased strength resulting from the increased spacing between the interior wall 21 and lip 22 while also accommodating the notches of existing trays during cross stacking.

The trays 10 are preferably injection molded of polypropylene, polyethylene or other suitable material. Other suitable processes may also be used.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope. Alphanumeric identifiers on method steps are for convenient reference in dependent claims and do not signify a required sequence of performance unless otherwise indicated in the claims.

What is claimed is:

1. A tray comprising:

a base including a plurality of vertical ribs, the vertical ribs having a plurality of notches;

a pair of opposed side walls extending upward from side edges of the base; and a front wall and a rear wall extending upward from a front edge and a rear edge of the base, the front wall and rear wall each having at least a portion that is shorter than the side walls, the front wall and rear wall each including an inner wall portion spaced inwardly of an outer wall portion, the front wall and rear wall each including at least two spaced-apart portions of reduced width at an upper edge of the front wall and the rear wall, wherein the portions of reduced width have reduced width relative to other portions of the front wall and rear wall, wherein each of the at least two portions of reduced width is offset toward the outer wall portion, thereby forming a recess on the inner wall portion, wherein the portions of reduced width are capable of being simultaneously received in the plurality of notches of an identical tray cross-stacked thereon.

2. The tray of claim 1 wherein each of the at least two portions of reduced width in the front wall is shorter than the side walls.

3. The tray of claim 1 wherein each of the at least two portions of reduced width includes an upper surface that is capable of being received in the plurality of notches of the identical tray cross-stacked thereon, the upper surface extends in a direction generally parallel to the base.

4. The tray of claim 1 including at least one pair of lateral flanges extending inward from the pair of side walls, wherein the at least one pair of lateral flanges are spaced from each of the at least two portions of reduced width.

5. The tray of claim 1 wherein each of the at least two portions of reduced width includes an inner surface offset toward an exterior of the tray further than an inner surface of the inner wall portion.

6. The tray of claim 1, wherein the tray is a lower tray in combination with the identical tray cross-stacked thereon, wherein the identical tray is an upper tray, wherein the portions of reduced width of the lower tray are simultaneously received in the plurality of notches of the upper tray while cross-stacked thereon with the base of the upper tray parallel to the base of the lower tray.

7. The tray of claim 1 wherein each of the at least two portions of reduced width has a single wall thickness.

8. The tray of claim 7 wherein each of the at least two portions of reduced width has a plurality of horizontal ribs extending from the single wall.

9. The tray of claim 8 wherein the side walls each include an inner rail and an outer rail defining a channel therebetween.

10. The tray of claim 9 wherein the side walls each include a plurality of pockets opening toward an interior of the tray, the side walls further including a plurality of feet receivable in the plurality of pockets of an identical tray on which the tray is stacked.

11. A tray comprising:

a base including a plurality of vertical ribs, at least one of the vertical ribs having at least one notch;

a pair of first walls extending upward from first edges of the base;

a pair of opposed second walls extending upward from opposed second edges of the base, the second walls each having at least a portion that is shorter than the first walls, the second walls each including an inner wall surface and an outer wall surface, the inner surfaces of the second walls each including a pair of recessed portions at an upper edge of the second walls, wherein the inner surfaces of the second walls at the recessed portions are offset outwardly of the tray relative to the inner surface of the second walls other than at the recessed portions, wherein the recessed portions are capable of being received in the at least one notch of an identical tray cross-stacked thereon such that the base of the identical tray is parallel to the base of the tray.

12. The tray of claim 11 wherein the recessed portions include an upper surface that are capable of being received in the at least one notch of an identical tray cross-stacked thereon, the upper surface extends in a direction generally parallel to the base.

13. The tray of claim 11, wherein the tray is a lower tray in combination with the identical tray cross-stacked thereon, wherein the identical tray is an upper tray, the base of the upper tray is parallel to the base of the lower tray, the recessed portions of the lower tray are simultaneously received in the plurality of notches of the upper tray while cross-stacked thereon.

14. The tray of claim 11 wherein the recessed portions are portions of reduced width relative to the at least a portion that is shorter than the first walls other than the portions of reduced width and wherein the portions of reduced width have a single wall thickness.

15. The tray of claim 14 wherein the portions of reduced width have a plurality of horizontal ribs extending from the single wall.

16. The tray of claim 15 wherein the first walls each include an inner rail and an outer rail defining a channel therebetween.

17. The tray of claim 16 wherein the first walls each include a plurality of pockets opening toward an interior of the tray, the first walls further including a plurality of feet receivable in the plurality of pockets of an identical tray on which the tray is stacked.

18. A tray comprising:

a base including a plurality of vertical ribs, at least one of the ribs having at least one notch;

a pair of opposed side walls extending upward from side edges of the base;

a front wall and a rear wall extending upward from a front edge and a rear edge of the base, wherein the front wall and rear wall are shorter than the side walls, the front wall and rear wall each including an inner wall portion spaced inwardly of an outer wall portion, the front wall and rear wall each including a single-wall thickness portion at an upper edge of the front wall and the rear wall, an innermost surface of each of the front wall and rear wall offset toward an exterior of the tray at each single wall thickness portion, wherein the single-wall thickness portion is capable of being received in the at least one notch of an identical tray cross-stacked thereon such that the base of the identical tray is parallel to the base of the tray; and lateral flanges extending inward from each of the side walls on the upper edge of the front wall, the lateral flanges taller than the single wall thickness portions, the single wall thickness portions of the front wall between the lateral flanges.

19. The tray of claim 18 wherein the single-wall thickness portion is above the inner wall portion and the outer wall portion.

20. The tray of claim 19 wherein the single-wall thickness portion has a width less than a distance between an inner surface of the inner wall portion and an outer surface of the outer wall portion.

21. A tray comprising:

a base including a plurality of vertical ribs, the vertical ribs having a plurality of notches;

a pair of opposed side walls extending upward from opposed sides of the base; and a front wall and a rear wall extending upward from a front and a rear of the base, the front wall and rear wall each having at least a portion that is shorter than the side walls, the front wall and rear wall each including an inner wall portion spaced inwardly of an outer wall portion, the front wall and rear wall each including two spaced-apart portions of reduced width adjacent an upper edge of the front wall and the rear wall, the portions of reduced width having reduced width relative to other portions of the front wall and rear wall, each of the at least two portions of reduced width having a single wall thickness, each of the at least two portions of reduced width having a plurality of horizontal ribs extending from the single wall, wherein the portions of reduced width are capable of being simultaneously received in the plurality of notches of an identical tray cross-stacked thereon.

22. The tray of claim 21 wherein the side walls each include an inner rail and an outer rail defining a channel therebetween, wherein the side walls each include a plurality of pockets opening toward an interior of the tray, the side walls further including a plurality of feet receivable in the plurality of pockets of an identical tray on which the tray is stacked.

23. The tray of claim 21 wherein the portions of reduced width are single-wall thickness portions.

* * * * *